US005880384A

United States Patent [19]

Beck

[11] Patent Number: 5,880,384

[45] Date of Patent: Mar. 9, 1999

[54] CONNECTING DEVICE FOR ATTACHING SHOULDER STRAP TO STRINGED INSTRUMENT

[76] Inventor: Richard Beck, 2898 S. Southward Dr., Warsaw, Ind. 46580

[21] Appl. No.: 992,865

[22] Filed: Aug. 20, 1997

[51] Int. Cl.[6] ..... G10D 3/00

[52] U.S. Cl. ..... 84/327; 84/453

[58] Field of Search ..... 84/327, 453; 224/910, 224/257, 258, 271; 24/2.5

[56] References Cited

U.S. PATENT DOCUMENTS 5,596,158 1/1997 Tonin ..... 82/327

5,757,711 5/1998 Cavaness et al. ..... 84/291

*Primary Examiner*—William M. Shoop, Jr.
*Assistant Examiner*—Kim Lockett
*Attorney, Agent, or Firm*—Baker & Daniels

[57] ABSTRACT

A shoulder strap of an acoustic guitar or similar stringed instrument is attached to the neck of the instrument through an attachment device including a looped portion which extends beneath the strings along one side of the neck, and across the bottom of the neck, and along the opposite side of the neck to be joined to the end portion adjacent the top edge of the neck. The fastener joins the end portions together, and is provided with a stem and a head over which the slotted end of the guitar strap may be manipulated to rest on the stem and be retained on the fastener by the head.

18 Claims, 4 Drawing Sheets

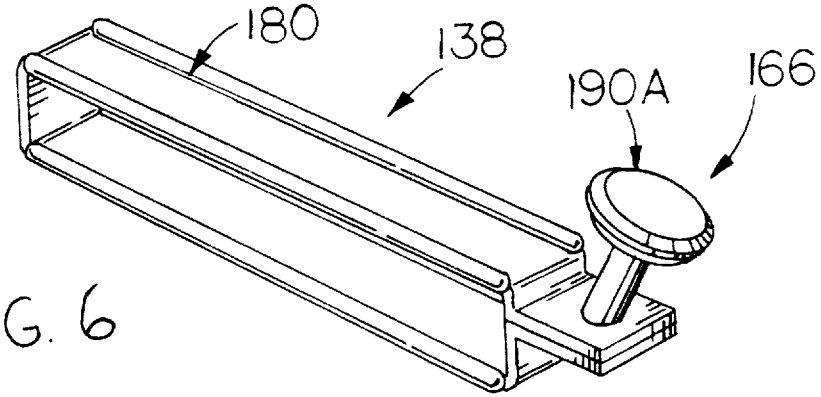
FIG. 6
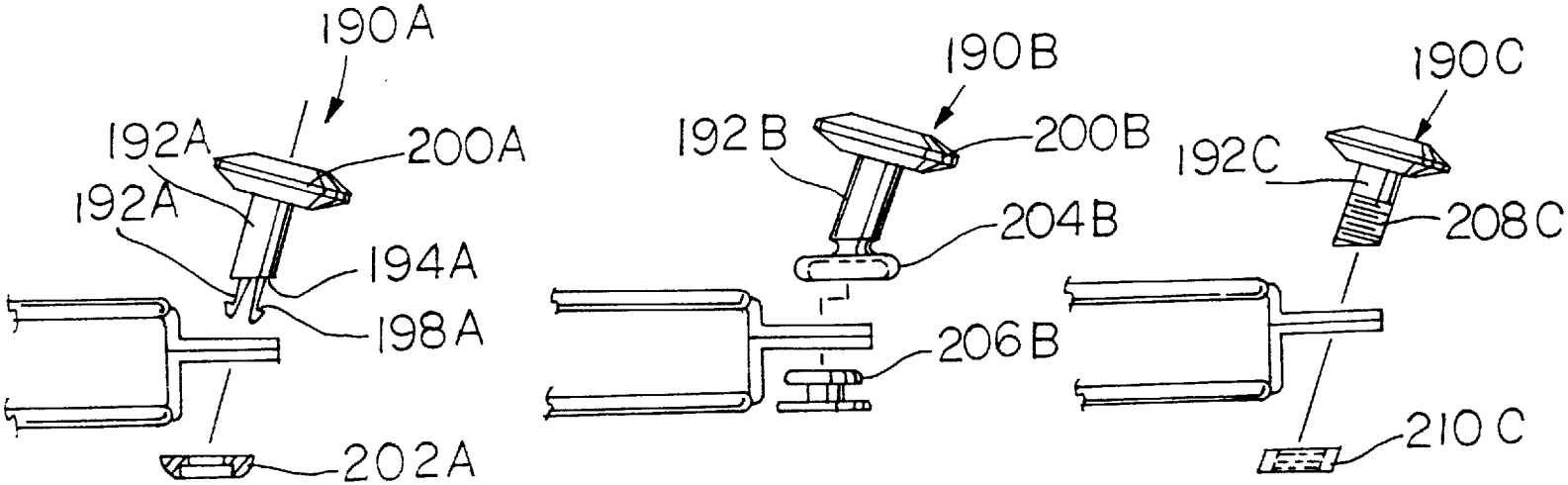
FIG. 9
FIG. 8
FIG. 7

CONNECTING DEVICE FOR ATTACHING SHOULDER STRAP TO STRINGED INSTRUMENT

This invention relates to a connecting device for attaching the shoulder strap of a stringed instrument, such as an acoustic guitar, to the neck of the instrument.

Acoustic guitars normally are provided with a shoulder strap that supports the guitar in the playing position on the person playing the guitar. The guitar includes a body, an elongated neck extended from the body, and strings supported off of the neck and the body by bridges. One end of the shoulder strap is normally connected to the body, and the other end is connected to the neck of the guitar. Prior connecting devices for connecting the end of the strap to the neck of the stringed instrument have involved devices which are attached to the neck by drilling through the neck. This must be done extremely carefully or the instrument will be damaged, and has generally proven to be unsatisfactory. Accordingly, many players attach the strap to the neck of a guitar by using strings to tie the strap to the neck of the guitar. This is unsightly, and it is impossible to change straps quickly. Performers often wish to change straps on a fairly regular basis, sometimes even during a performance. Accordingly, it is desirable to provide an attachment device that enables the strap to be connected and disconnected quickly, but which is also attractive and relatively unobtrusive. Of course, it is also desirable that the device attaching the strap to the neck be secured to the neck without drilling or otherwise damaging the neck.

According to the present invention, an attachment device for attaching a strap to the neck of a guitar or similar stringed instrument includes a portion which encircles the neck of the instrument and extends between the strings and the neck. The device includes a pair of opposite ends which extend above the upper surface of the neck and are joined together by a fastener, which includes a stem which projects from the fastener and terminates a head over which a slot in the end of the guitar strap may be installed. Accordingly, the end of the guitar strap may be quickly and easily attached to the neck, and may be quickly disconnected and replaced. No drilling is required, and the strap may be easily changed..

These and other advantages of the present invention will become apparent from the following description, with reference to the accompanying drawings, in which:

FIG. 6 is a view in perspective similar to FIG. 3 but of the embodiment of the attachment device illustrated in FIG. 4 and 5;

FIG. 7, FIG. 8 and FIG. 9 are fragmentary exploded side elevational views illustrating different embodiments of the fastening and connecting devices used in the attachment device of FIGS. 2–6.

Figure 1:
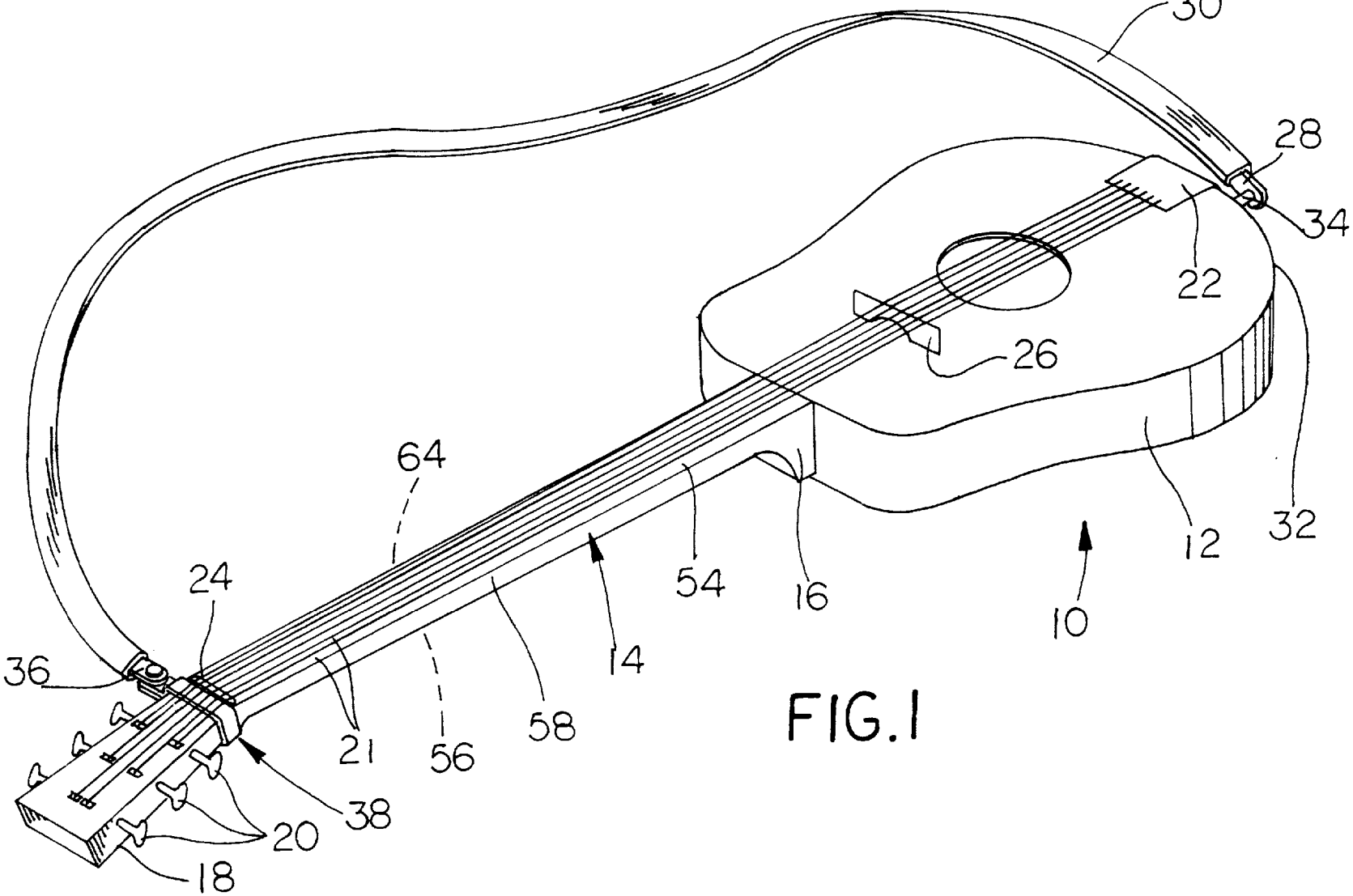
FIG. 1 is a view in perspective of a acoustic guitar including a strap and a device for attaching the strap to the neck of the instrument made pursuant to the teachings of the present invention.

Referring now to the drawings, a stringed instrument, such as an acoustic guitar, is generally indicated by the numeral 10 in FIG. 1 and includes a body 12 from which a neck 14 extends. One end 16 of the neck 14 is secured to the body 12, and the opposite end 18 carries pegs 20 which are used to tune the strings 20 which extend along the neck 14 and over the body 12 to an attachment 22 to the body 12. Bridges 24, 26 hold the strings 21 off of the neck and body 12. One end 28 of a shoulder strap 30 is connected to the end 32 of the body 12 via a conventional attachment knob 34 and the opposite end 36 of the shoulder strap 30 is attached to the neck 14 adjacent the bridge 24 by an attachment device generally indicated by the numeral 38.

Figures 2, 3:
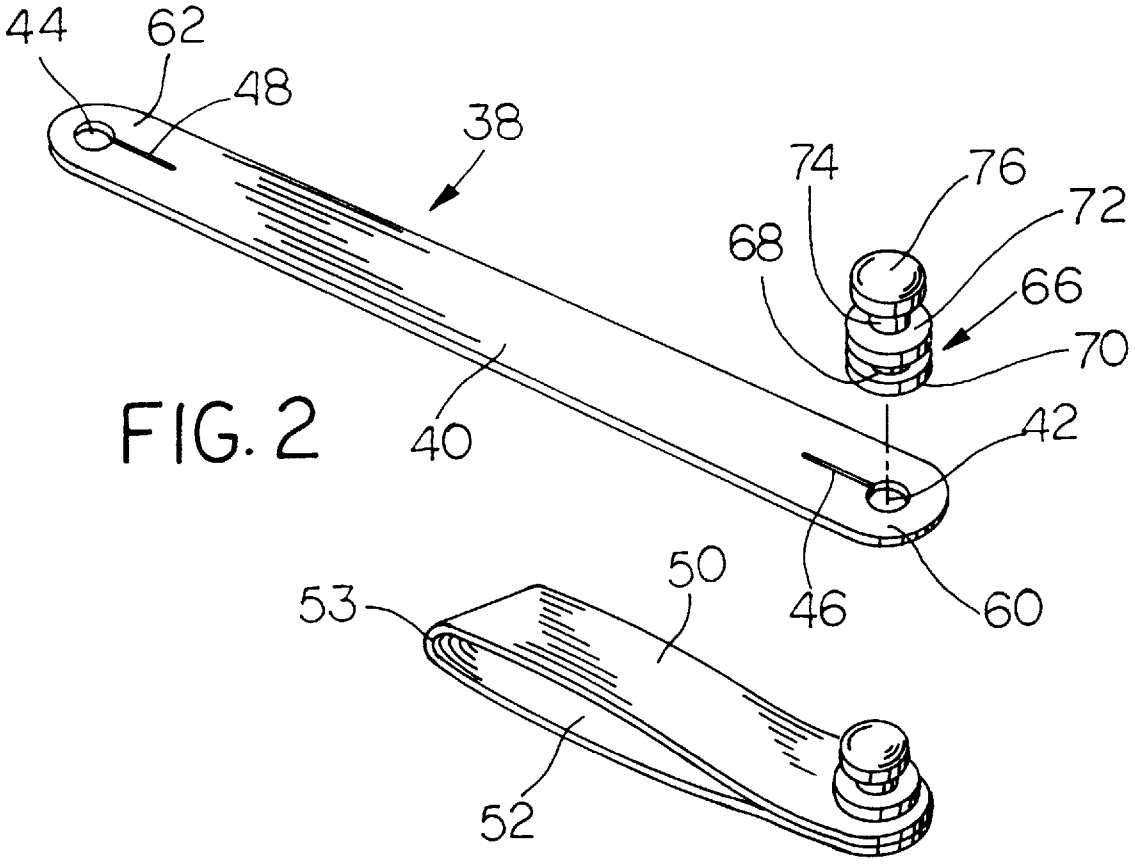
FIG. 2 is a view in perspective of one embodiment of the attachment device used in FIG. 1 before the device has been folded and installed on the instrument.
FIG. 3 is a view in perspective of the attachment device folded as it would be when installed on the instrument illustrated in FIG. 1; the instrument is not shown in FIG. 3 for clarity.

The attachment device 38 according to one embodiment of the invention includes a strip 40 of flexible material in which apertures 42, 44 are formed in the opposite ends thereof. Slots 46, 48 extend from the apertures. As illustrated in FIG. 3, the strip 40 can be folded to form overlying portions 50, 52 and a connecting portion 54. The portion 50 is installed between the strings and the upper surface 54 of the neck 14, and the portion 52 is installed so that it overlies the surface 56 of the neck 14 opposite the surface 54. Connecting portion 53 extends around the lower edge 58 of the neck 14, and the end portion 60, 62 in which the apertures 42, 44 are formed extend above the upper edge 64 of the neck 14 where they are joined together by a fastener generally indicated by the numeral 66.

The fastener 66 includes a connecting section 68 of reduced diameter that extends between buttons 70, 72 of a greater diameter. Accordingly, the slots 46, 48 may be slipped over one or the other buttons of the buttons 70 and 72 so that the apertures 42, 44 may rest around the connecting section 68. Accordingly, the apertures 42, 44 are the same diameter as, or slightly larger than, connecting section 68. The strip 40 is made out of leather or a similar flexible material but with sufficient rigidity such that the fastener 66 will not become easily dislodged from the apertures 42, 44.

A stem 74 projects from the button 72 and terminates in a head 76. The end 36 of the shoulder strap 30 includes a slotted aperture (not shown) similar to the slot of apertures 42 or 44 that is able to slip over the head 76 and onto the stem 74, thereby providing an attachment for the should strap 30. Accordingly, attachment device 38 secures the shoulder strap 30 to the neck 14 in a neat, easily removable manner that does not require drilling through the neck 14. Furthermore, strap 30 can be changed easily since the end portion 36 can easily be removed around the head 76 and the end portion 28 can just as easily be removed from the fixture 34 when the strap is changed. Therefore, performers using the stringed instrument 10 can easily change between straps of different decorations during a musical performance.

Figure 4:
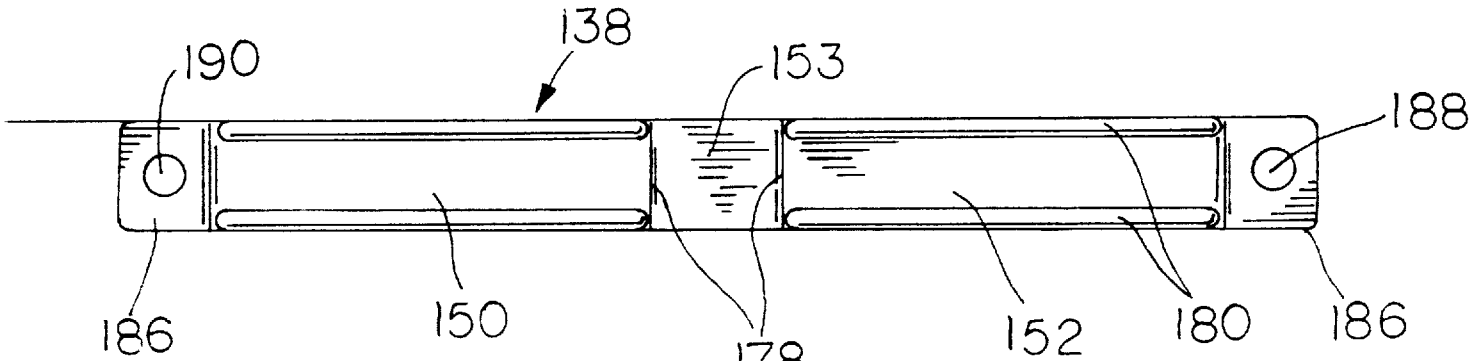
FIG. 4 is a top plan view of another embodiment of the attachment device illustrated in FIGS. 2 and 3, FIG. 4 being taken substantially along lines 4—4 of FIG. 5.
Figure 5:
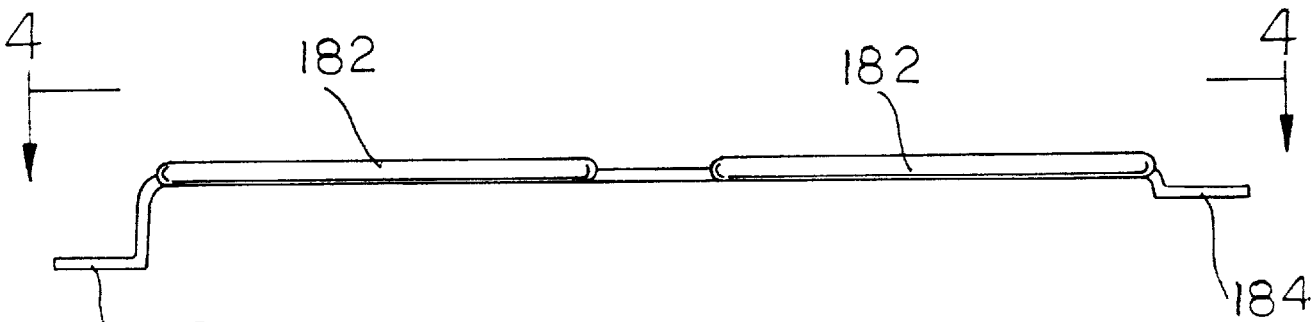
FIG. 5 is a side elevational view of the attachment device illustrated in FIG. 4.

Referring now to FIGS. 4–6, an attachment device 138 constituting another embodiment of the present invention includes side portion 150, 152 and a connecting portion 153. Preferably, attachment device 138 is made of bendable plastic or a similar material. The portions 150, 152 can be bent around score lines 178 to fold the attachment device 138 into a loop generally indicated by the numeral 180 in FIG. 6. The side portions 150, 152 are provided with reinforcing ribs 182. Opposite ends of the device 138 are provided with offset ears 184, 186 which, when the attachment device 138 is folded into the shape indicated in FIG. 6, a fastening device generally indicated by the numeral 166 can be installed through apertures 188, 190 in the ears 184, 186. Accordingly, portions 150, 152 extend along the upper and lower sides 54, 56 of the neck 14 when the device 138 is used to attach the strap 30 to the instrument 10. The ears

184, 186 are fastened together by any of the fasteners 190A, 190B, or 190C, as illustrated in FIGS. 7–9. The fasteners 190A, 190B, or 190C may also be used to connect the end of the fastening device 38 in place. The fastener 190A includes a stem 192A which is provided with an angled surface 194A from which deflectable barbed arms 196A, 198A extend. An enlarged head 200A is formed on the opposite end of the stem 192A. A nut 202A, shown in cross section in FIG. 7, latches with the arms 196A, 198A after the latter have been passed through the apertures 188, 190. The strap end 36 can then be passed over the head 190A and on to the stem portion 192A.

Referring to FIG. 8, the fastener 190B includes a stem 192B, a head 200B on one end of the stem 192B, and an enlarged snap socket 204B on the opposite end of the stem 192B. The snap socket 204B is adapted to frictionally receive a snap head 206B which is sized to fit through the apertures 188, 190 to engage the snap socket 204B in a manner well known to those skilled in the art. Again, the end 36 of the strap 30 may be installed over the head 200B over the stem 192B.

Referring to the embodiment of FIG. 9, a fastener 190C includes a stem 192C glided with thread 208C. A threaded nut 210C received the threaded end 208C after the latter has been installed through the apertures 188, 190.

What is claimed:

1. Attachment device for attaching a shoulder strap to a stringed musical instrument, said instrument having a body, a neck having an end attached to the body and an opposite end, and strings extending over said body and neck, said neck including a bridge holding the strings off of said neck, said attachment device including a portion extending around said neck, said portion having a pair of ends connected by a fastening device, and connecting means for connecting said portion to said shoulder strap.

2. Attachment device as claimed in claim 1, wherein said connecting means includes a stem extending from the fastening device and a head on said stem.

3. Attachment device as claimed in claim 2, wherein said fastening device includes a section extending through said portion and a pair of buttons on opposite sides of said section, said stem extending from one of the buttons.

4. Attachment device as claimed in claim 1, wherein said portion is a loop of flexible material.

5. Attachment device as claimed in claim 4, wherein a slot is defined in each of said ends, said fastening device including a section extending through said slot and a pair of buttons on opposite ends of said section to prevent the section from being pulled through the slot, said stem extending from one of said buttons.

6. Attachment device as claimed in claim 1, wherein said neck includes a front surface over which the strings extend, a back surface opposite said front surface, and top and bottom edges interconnecting said front and back surfaces, said portion extending along said front and back surfaces and along said bottom edge, said ends projecting from said top edge, said fastening device extending through said ends, said connecting means extending from the fastening device.

7. Attachment means as claimed in claim 6, wherein said connecting means includes a stem extending from the fastening device and a head on said stem.

8. Attachment means as claimed in claim 6, wherein said portion is a loop of flexible material.

9. Attachment means as claimed in claim 6, wherein said portion includes a pair of parallel side members extending along said surfaces of the neck, and top and bottom end members interconnecting said side members, said fastening means joining separate sections of said top end member.

10. Attachment means as claimed in claim 9, wherein said fastening means includes a pair of ears, and a fastener joining said ears.

11. Attachment means as claimed in claim 1, wherein said portion includes a pair of parallel side members extending along said surfaces of the neck, and top and bottom end members interconnecting said side members, said fastening means joining separate sections of said top end member.

12. Attachment means as claimed in claim 1, wherein said fastening means includes a section extending through said ends and a pair of buttons on opposite ends of said section to prevent the section from being pulled through the slot, said stem extending from one of said buttons.

13. Attachment means as claimed in claim 1, wherein said fastening means includes a snap fastener comprising mating snap members, one of said snap members extending through said ends to engage the other snap members said connecting means including a stem extending from said snap fastener and a head on said stem.

14. Attachment means as claimed in claim 1, wherein said fastening means includes a pair of members, one of said members having a pair of deflectable legs extending through said ends to engage the other member, said connecting means including a stem extending from said one member and a head on said stem.

15. Attachment means as claimed in claim 1, wherein said fastening means includes a screw extending through said ends to engage a nut to thereby hold the ends together, said connecting means including a stem extending from said screw and a head on said stem.

16. Attachment device for attaching a shoulder strap to a stringed musical instrument, said instrument having a body, a neck having an end attached to the body and an opposite end, and strings extending over said body and neck, said neck including a bridge holding the strings off of said neck, said attachment device including a loop extending around said neck, said loop having a pair of ends connected by a fastening device, said fastening device including a stem and a head on the stem, said shoulder strap being connected to the attachment device through said stem.

17. Attachment means as claimed in claim 16, wherein said neck includes a front surface over which the strings extend, a back surface opposite said front surface, and top and bottom edges interconnecting said front and back surfaces, said loop extending along said front and back surfaces and along said bottom edge, said ends projecting from said top edge, said stem including a first section extending through said ends, and a second section engaged by the shoulder strap.

18. Attachment means as claimed in claim 17, wherein a pair of buttons on opposite ends of said first section prevents the first section from being pulled from said ends, said second section extending from one of said buttons.

* * * * *